US012195994B2

(12) United States Patent
Snapir

(10) Patent No.: US 12,195,994 B2
(45) Date of Patent: Jan. 14, 2025

(54) MOTORIZED BARRIER DEVICES

(71) Applicant: SMART FENCE LTD, Karme Yosef (IL)

(72) Inventor: Nir Snapir, Karme Yosef (IL)

(73) Assignee: SMART FENCE LTD, Karme Yosef (IL)

( * ) Notice: Subject to any disclaimer, the term of this patent is extended or adjusted under 35 U.S.C. 154(b) by 0 days.

(21) Appl. No.: 18/721,200

(22) PCT Filed: Apr. 14, 2022

(86) PCT No.: PCT/IL2022/050394
§ 371 (c)(1),
(2) Date: Jun. 18, 2024

(87) PCT Pub. No.: WO2023/131938
PCT Pub. Date: Jul. 13, 2023

(65) Prior Publication Data

US 2024/0417989 A1 Dec. 19, 2024

(30) Foreign Application Priority Data

Jan. 6, 2022 (IL) ..... 289665

(51) Int. Cl.
*E04B 1/12* (2006.01)
*E01F 13/04* (2006.01)
*E04H 4/06* (2006.01)

(52) U.S. Cl.
CPC ..... *E04H 4/06* (2013.01); *E01F 13/046* (2013.01)

(58) Field of Classification Search
CPC ..... E04H 4/06; E01F 13/046
See application file for complete search history.

(56) References Cited

U.S. PATENT DOCUMENTS 4,135,256 A 1/1979 Limegrover
4,262,373 A 4/1981 Chambers
4,531,472 A * 7/1985 Marrero ..... E01F 13/048 116/28 R
4,627,763 A * 12/1986 Roemer ..... E01F 13/08 404/11
4,715,742 A * 12/1987 Dickinson ..... E01F 13/046 404/6

(Continued)

FOREIGN PATENT DOCUMENTS

CA 1263067 A 11/1989
CN 101228328 A 7/2008

(Continued)

*Primary Examiner* — Basil S Katcheves
(74) *Attorney, Agent, or Firm* — Bridgeway IP Law Group, PLLC; Hyun Woo Shin

(57) ABSTRACT

Present invention is for motorized barrier devices, access management systems for managing access to protected areas and installations for protecting protected areas. The motorized barrier devices include a housing (11), a horizontal rigid beam (21) having a storage position and a barrier position raised with respect to the storage position, a pair of folding arms (29,39) between the housing and the horizontal rigid beam, and a motorized gear arrangement (28,39) for raising the horizontal rigid beam from its storage position to its barrier position and lowering the horizontal rigid beam from its barrier position to its storage position.

14 Claims, 12 Drawing Sheets

(56) References Cited

U.S. PATENT DOCUMENTS

| | | | | |
|---|---|---|---|---|
| 4,818,137 | A * | 4/1989 | Gorlov | E01F 13/12 404/6 |
| 5,026,203 | A * | 6/1991 | Gorlov | E01F 13/12 404/6 |
| 5,267,358 | A | 12/1993 | Roy et al. | |
| D372,971 | S * | 8/1996 | Chescavage | D6/682.2 |
| 5,896,910 | A | 4/1999 | Chen | |
| 6,062,765 | A * | 5/2000 | Dotson | E01F 13/12 49/34 |
| 6,135,192 | A | 10/2000 | Suzuki et al. | |
| 6,267,169 | B1 | 7/2001 | McDonald | |
| 6,785,991 | B2 * | 9/2004 | Colip | G09F 13/22 40/606.15 |
| 7,021,242 | B2 * | 4/2006 | Axelrod | A01K 1/0245 119/498 |
| 7,048,027 | B1 | 5/2006 | Abita | |
| 9,080,781 | B1 * | 7/2015 | Turner | E04H 4/06 |
| 2005/0044804 | A1 * | 3/2005 | Bin | E04B 1/3445 52/79.5 |
| 2007/0034847 | A1 * | 2/2007 | Shertzer | E04H 17/22 256/65.14 |
| 2007/0194674 | A1 | 8/2007 | Salter | |
| 2009/0014136 | A1 | 1/2009 | Lekar | |
| 2010/0001860 | A1 * | 1/2010 | Boudreau | G08B 21/086 256/26 |
| 2010/0186159 | A1 | 7/2010 | Dalickas | |
| 2013/0221301 | A1 * | 8/2013 | Cowie | E04H 17/00 256/24 |
| 2014/0090788 | A1 | 4/2014 | McDonald | |
| 2014/0332743 | A1 * | 11/2014 | Walker | E04H 17/1439 256/64 |
| 2015/0300025 | A1 | 10/2015 | Cittadine | |
| 2018/0080269 | A1 | 3/2018 | McDonald | |
| 2020/0385124 | A1 | 12/2020 | Zhang | |

FOREIGN PATENT DOCUMENTS

| | | | |
|---|---|---|---|
| CN | 106761331 | A | 5/2017 |
| CN | 108843124 | A | 11/2018 |
| CN | 109519035 | A | 3/2019 |
| FR | 2842234 | A1 | 1/2004 |
| FR | 2861112 | A1 | 4/2005 |
| GB | 374187 | A | 6/1932 |
| IT | 1242451 | B | 3/1994 |
| WO | 2009/019171 | A1 | 2/2009 |

* cited by examiner

MOTORIZED BARRIER DEVICES

FIELD OF THE INVENTION

The invention relates to motorized barrier devices.

BACKGROUND OF THE INVENTION

Motorized barrier devices are designed for cyclic raising and lowering a barrier. Barriers can be in the form of bollards, booms, and the like. Motorized barrier devices can be deployed either as permanent fixtures or portable fixtures.

Motorized barrier devices can be employed as manually operated standalone items. Alternatively, motorized barrier devices can be operated by a remote control, a smartphone app, and the like.

SUMMARY OF THE INVENTION

The present invention is for motorized barrier devices, access management systems for managing access to protected areas and installations for protecting protected areas. The motorized barrier devices include a housing, a horizontal rigid beam having a storage position and a barrier position raised with respect to the storage position, a pair of folding arms between the housing and the horizontal rigid beam, and a motorized gear arrangement for raising the horizontal rigid beam from its storage position to its barrier position and lowering the horizontal rigid beam from its barrier position to its storage position. The motorized gear arrangement includes a horizontal axle, a motor for rotating the horizontal axle in one direction and an opposite direction, and a pair of worm gears at the opposite axle ends for driving the pair of folding arms from a substantially horizontal folded position to a substantially upright extended position on rotation of the horizontal axle in one direction and from their substantially upright extended position to their substantially horizontal folded position on rotation of the horizontal axle in the opposite direction. The left worm gear and the right worm gear correspondingly rotate the left folding arm and the right folding arm through a near right angle between their folded position to their extended position. The motorized barrier devices form a rigid frame in their barrier positions and include a self-winding flexible barrier fitment initially stored in a housing and raised to form a barrier supported on their rigid frame in their barrier positions. A flexible barrier fitment enables raising a horizontal rigid beam until the flexible barrier fitment is stretched heightwise tautly, thereby determining the horizontal rigid beam's barrier position. The flexible barrier fitment self-winds on lowering the horizontal rigid beam from its barrier position to its storage position. The flexible barrier fitment preferably also includes a spring biased self-winding left cable and a spring biased self-winding right cable for ensuring it is also stretched widthwise tautly The motorized barrier devices of the present invention can be provisioned with flexible barrier fitments of different lengths and/or different heights for different applications. The flexible barrier fitments have a maximum height limited by their length because each folding arm in its folded state is necessarily shorter than half a motorized barrier device's length. The motorized barrier devices are designed to have a suitable gear ratio depending on its intended application in terms of a flexible barrier fitment's weight, duration to raise and lower a flexible barrier, and the like.

Motorized barrier devices of the present invention can be deployed end-to-end to completely surround a protected area, for example, a building site, a swimming pool, and the like. Motorized barrier devices can be deployed in a trench such that they are flush fit with a border adjacent a protected area for convenience and/or aesthetic purposes. Motorized barrier devices can be engineered to meet national technical standards in terms of sturdiness, barrier height, and the like, for different applications. For example, motorized barrier devices of the present invention can be engineered to comply with swimming pool fence regulations.

Access management systems for managing access to protected areas can employ one or more motorized barrier devices of the present invention for preventing physical access for security reasons, safety reasons, and the like. Such access management systems can automatically control access to protected areas by employing commercially available data recognition capabilities including inter alia bar card readers, biometric recognition, vehicle registration recognition, and the like.

BRIEF DESCRIPTION OF DRAWINGS

In order to understand the present invention and to see how it can be carried out in practice, preferred embodiments will now be described, by way of non-limiting examples only, with reference to the accompanying drawings, in which similar parts are likewise numbered, and in which.

DETAILED DESCRIPTION OF DRAWINGS

Figure 1:
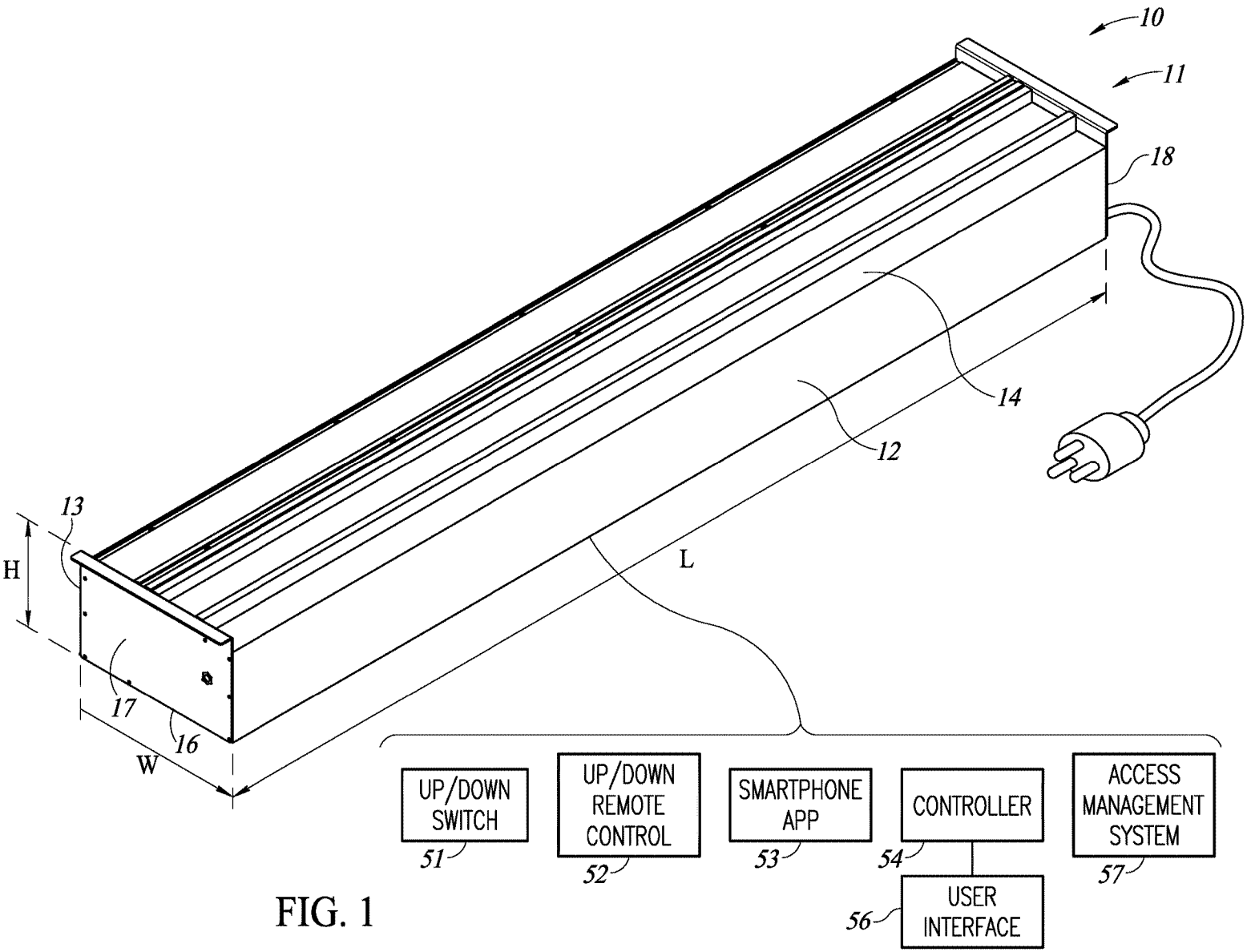
FIG. 1 is a combined front perspective view and schematic diagram of a motorized barrier device with a flexible barrier fitment constituted by sheet material in a storage position.
Figure 2A:
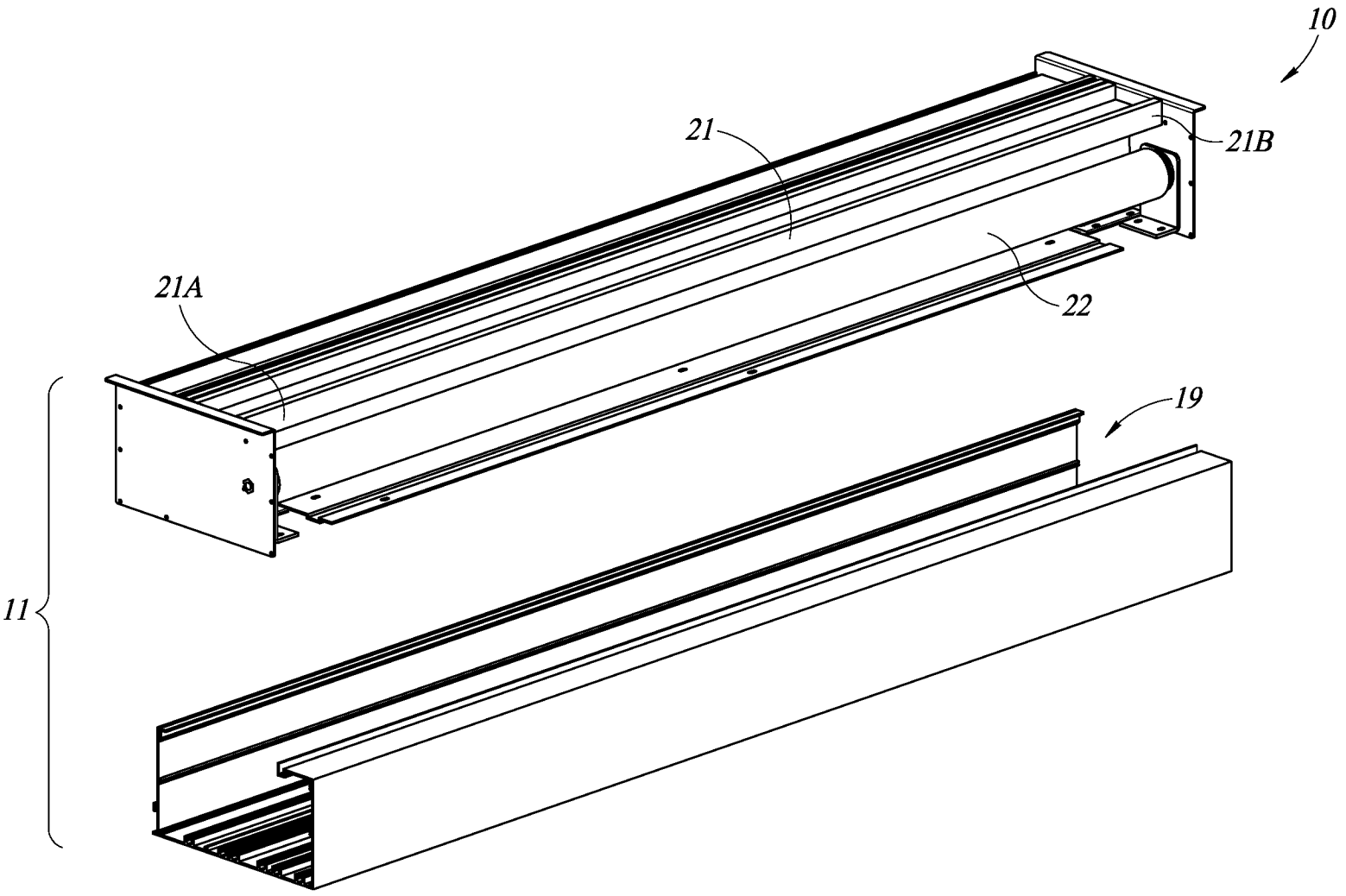
FIG. 2A is a partial exploded front perspective view of the motorized barrier device in a storage position.
Figure 2B:
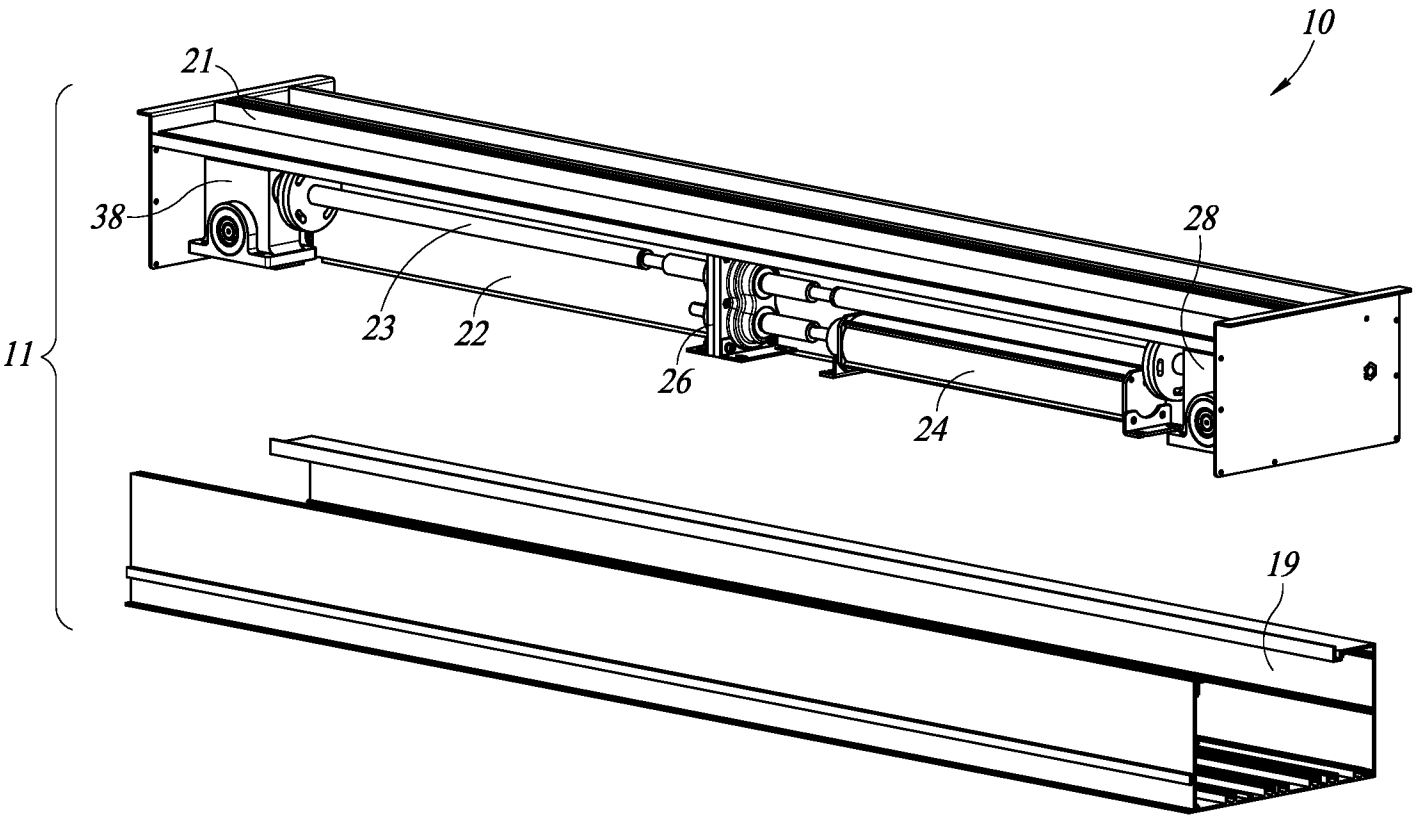
FIG. 2B is a partial exploded rear perspective view of the motorized barrier device in its storage position.
Figure 3:
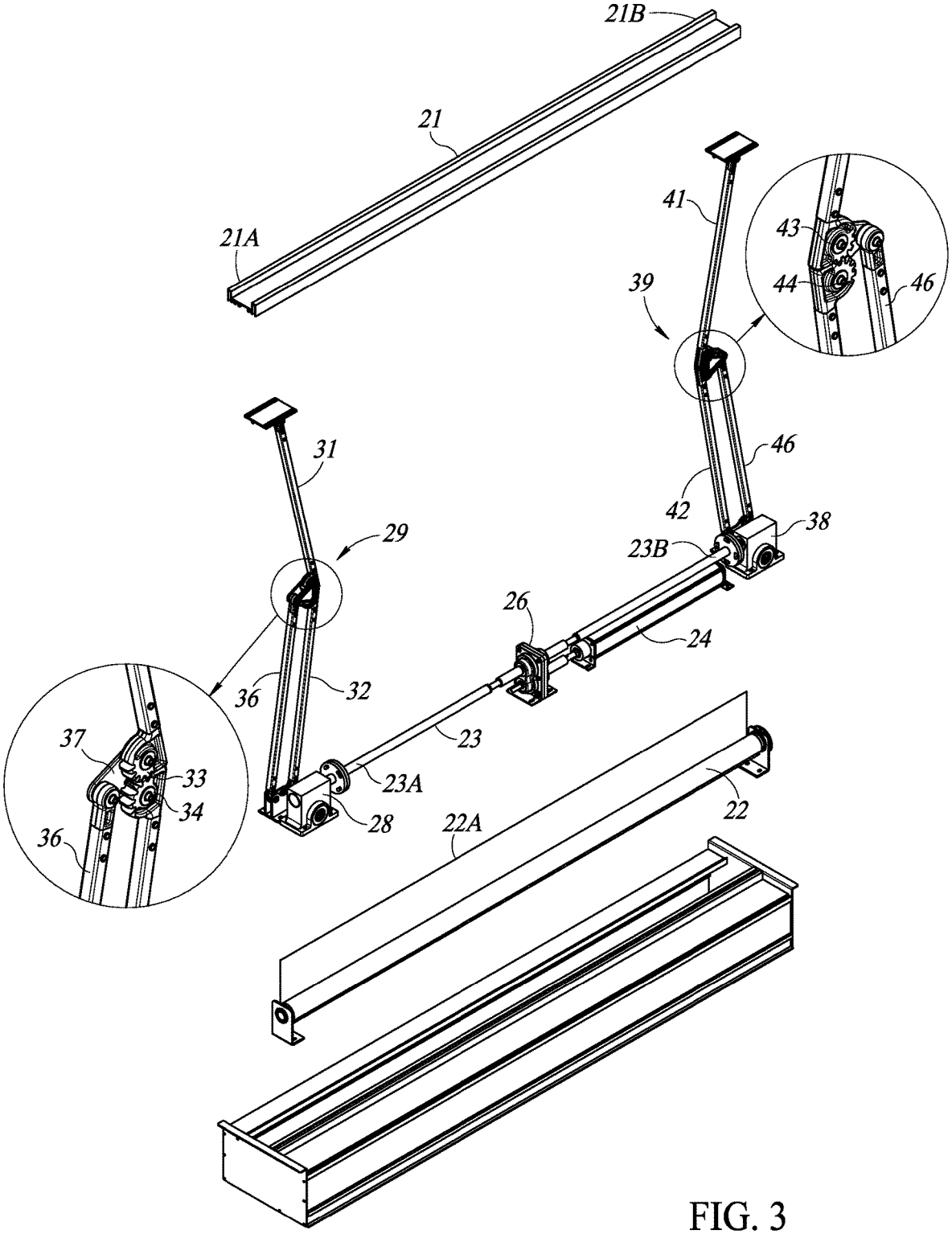
FIG. 3 is an exploded view of the motorized barrier device.
Figure 4A:
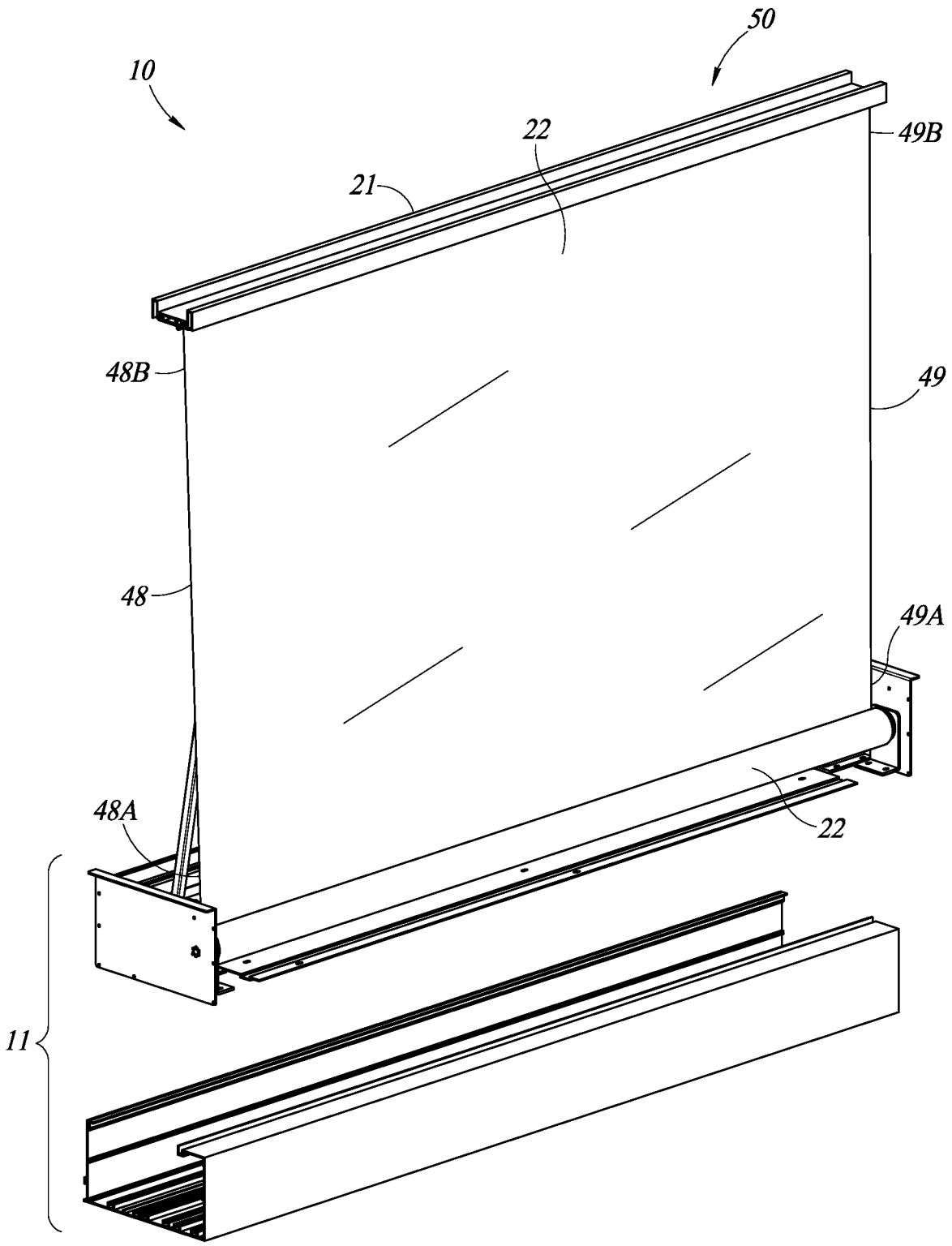
FIG. 4A is a partial exploded front perspective view of the motorized barrier device in a barrier position.
Figure 4B:
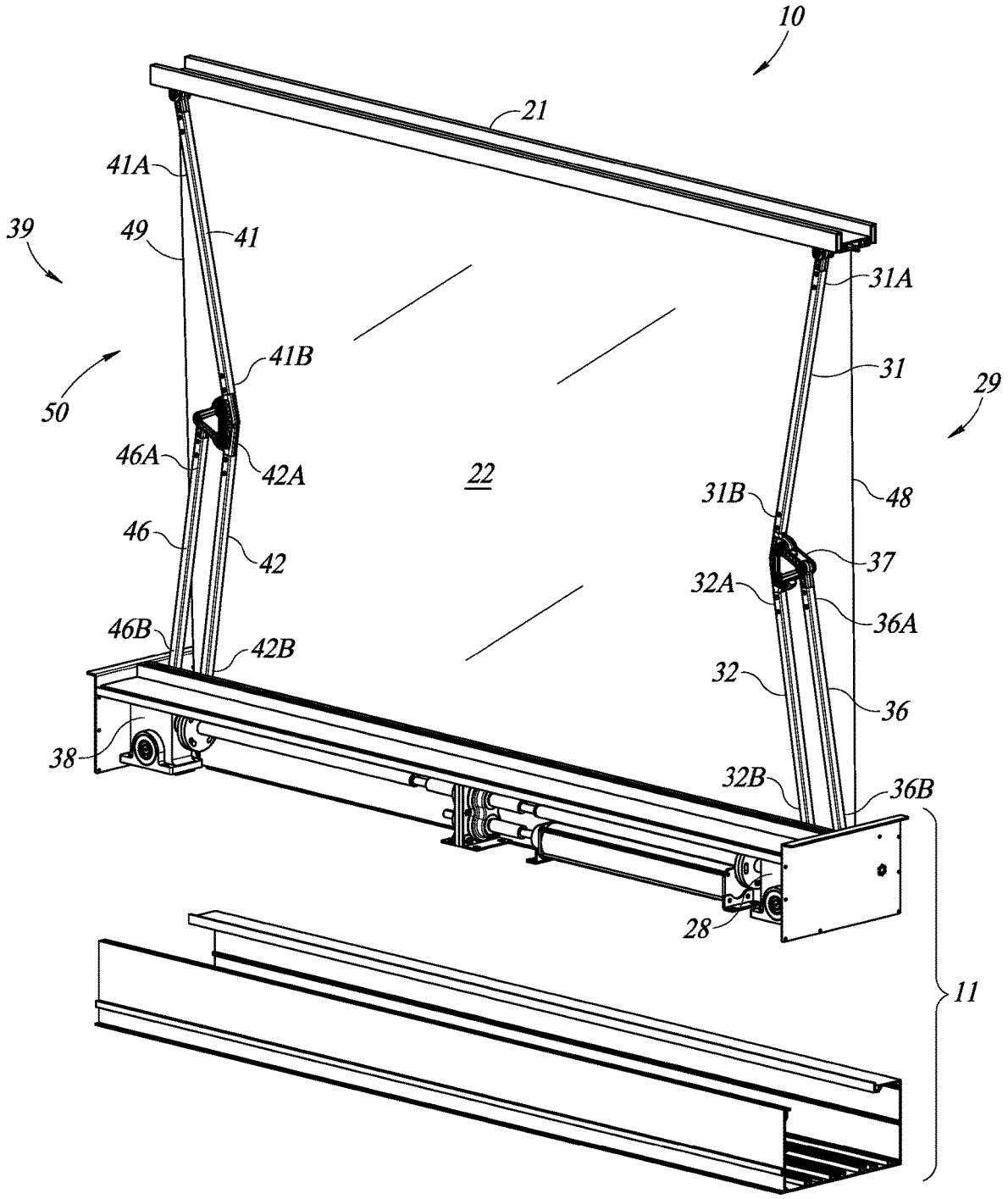
FIG. 4B is a partial exploded rear perspective view of the motorized barrier device in its barrier position.

FIG. 1 to FIG. 6 show a motorized barrier device 10 having a generally parallelopiped housing 11 with a front panel 12, a rear panel 13, a top panel 14, a bottom panel 16, a left end panel 17 and a right end panel 18. The top panel 14 is formed with an uppermost lengthwise slot 19 extending therealong. The housing 11 has the following external dimensions: length L, width W and height H. Length L can be a wide range of lengths from, say, 1 m to 3 m. Width W can be in a wide range of widths, say, 20 cm to 40 cm. Height H can be in a wide range of heights, say, 15 cm to 35 cm. The motorized barrier device 10 can be powered by the mains, a rechargeable battery, and the like.

The barrier device 10 includes a horizontal rigid beam 21 having a left beam end 21A and a right beam end 21B, the horizontal rigid beam 21 having a storage position and a barrier position raised with respect to the storage position. The horizontal rigid beam 21 is preferably flush with the top panel 14 in its storage position. The barrier device 10 includes a spring biased self-winding flexible barrier fitment 22 installed in the housing 11. The flexible barrier fitment 22 includes a leading flexible barrier fitment edge 22A attached to the horizontal rigid beam 21. The flexible barrier fitment 22 can be constituted by sheet material, mesh material, and the like. The flexible barrier fitment 22 can be constituted by cloth, plastic, metal, and the like.

The barrier device 10 includes a horizontal axle 23 having a left axle end 23A and a right axle end 23B, and co-extensive with the horizontal rigid beam 21. The barrier device 10 includes an electric motor 24 for clockwise and counterclockwise rotating the horizontal axle 23 via a gear transmission 26. The electric motor 24 is preferably a commercially available low profile tubular motor. The electric motor 24 preferably includes an automatic switch-off feature for automatically switching itself off when the motorized barrier device 10 is in its storage position and its barrier position.

The barrier device 10 includes a left worm gear 28 at the left axle end 23A for driving a left folding arm 29 between a folded position and an extended position. The left folding arm 29 includes a left upper arm 31 and a left lower arm 32. The left upper arm 31 includes a leading left upper arm end 31A pivotally connected to the horizontal rigid beam 21 and a trailing left upper arm end 31B with a left upper arm gear wheel 33. The left lower arm 32 includes a leading left lower arm end 32A with a left lower arm gear wheel 34 engaging the left upper arm gear wheel 33 and a trailing left lower arm end 32B driven by the left worm gear 28. The barrier device 10 further includes a left support arm 36 including a leading left support arm end 36A having a pivotally connected bracket 37 pivotally connected to the trailing left upper arm end 31B and the leading left lower arm end 32A and a trailing left support arm end 36B rotatably connected to the housing 11 such that the left support arm 36 moves in tandem with the left folding arm 29.

The barrier device 10 includes a right worm gear 38 at the right axle end 23B for driving a right folding arm 39 between a folded position and an extended position. The right folding arm 39 includes a right upper arm 41 and a right lower arm 42. The right upper arm 41 includes a leading right upper arm end 41A pivotally connected to the horizontal rigid beam 21 and a trailing right upper arm end 41B with a right upper arm gear wheel 43. The right lower arm 42 includes a leading right lower arm end 42A with a right lower arm gear wheel 44 engaging the right upper arm gear wheel 43 and a trailing right lower arm end 42B driven by the right worm gear 38. The barrier device 10 further includes a right support arm 46 including a leading right support arm end 46A having a pivotally connected bracket 47 pivotally connected to the trailing right upper arm end 41B and the leading right lower arm end 42A whereby the right support arm 46 moves in tandem with the right folding arm 39.

The flexible barrier fitment 22 preferably includes a spring biased self-winding left cable 48 on the barrier device 10's left side and a spring biased self-winding right cable 49 on the barrier device 10's right side. The flexible barrier fitment 22's left and right hems preferably have the left cable 48 and the right cable 49 stitched therein, respectively. The left cable 48 has a cable end 48A installed in the housing 11 and an opposite cable end 48B attached to either the horizontal rigid beam 21 or the leading left upper arm end 31A. The right cable 49 has a cable end 49A installed in the housing 11 and an opposite cable end 49B attached to either the horizontal rigid beam 21 or the leading right upper arm end 41A.

The flexible barrier fitment 22, the left folding arm 29, and the right folding arm 39 are dimensioned such that the flexible barrier fitment 22 restrains full extension of the left folding arm 29 and the right folding arm 39. In other words, raising the horizontal rigid beam 21 until the flexible barrier fitment 22 is stretched tautly heightwise restrains further raising the horizontal rigid beam 21 such that the flexible barrier fitment 22 determines the horizontal rigid beam 21's barrier position. The housing 11, the horizontal rigid beam 21 and the left folding arm 29 and the right folding arm 39 in their substantially upright extended positions constitute a rigid frame 50 for supporting the flexible barrier fitment 22. Tautly stretching the left cable 48 and the right cable 49 heightwise in turn leads to tautly stretching the barrier material therebetween. The left worm gear 28 and the right worm gear 38 are effectively self-locking in the sense that the barrier device 10 remains in its barrier position without operation of the electric motor 24.

The barrier device 10 can be operated by a manual UP/DOWN switch 51, an UP/DOWN remote control 52, a smartphone app 53, and the like. The barrier device 10 can issue alerts in the case of a malfunction, and the like. The barrier device 10 can be operated by a controller 54 having a user interface 56. The barrier device 10 can be automatically operated depending on its deployment. For example, a barrier device 10 can be automatically operated in accordance with a predetermined timing schedule. Alternatively, a barrier device 10 can be automatically operated in accordance with ambient light conditions, for example, in its storage position during daytime and barrier position during nighttime, or vice versa. Still again, a barrier device 10 can be automatically operated by an access management system 57 employing commercially available data recognition capabilities including inter alia bar card readers, biometric recognition, vehicle registration recognition, and the like.

Operation of the barrier device 10 between its storage position and its barrier position is as follows:

In its storage position, the horizontal rigid beam 21 is in its storage position flush with the top panel 14, the flexible barrier fitment 22 is fully self-wound, and the left folding arm 29 and the right folding arm 39 are inwardly folded towards one another. The left bracket 37 enables the left upper arm 31 to overlie the left lower arm 32 and the right bracket 47 enables the right upper arm 41 to overlie the right lower arm 42 for facilitating reducing the barrier device 10's height H. The left folding arm 29 and the right folding arm 39 are preferably generally horizontal in the barrier device 10's storage position.

Figure 5A:
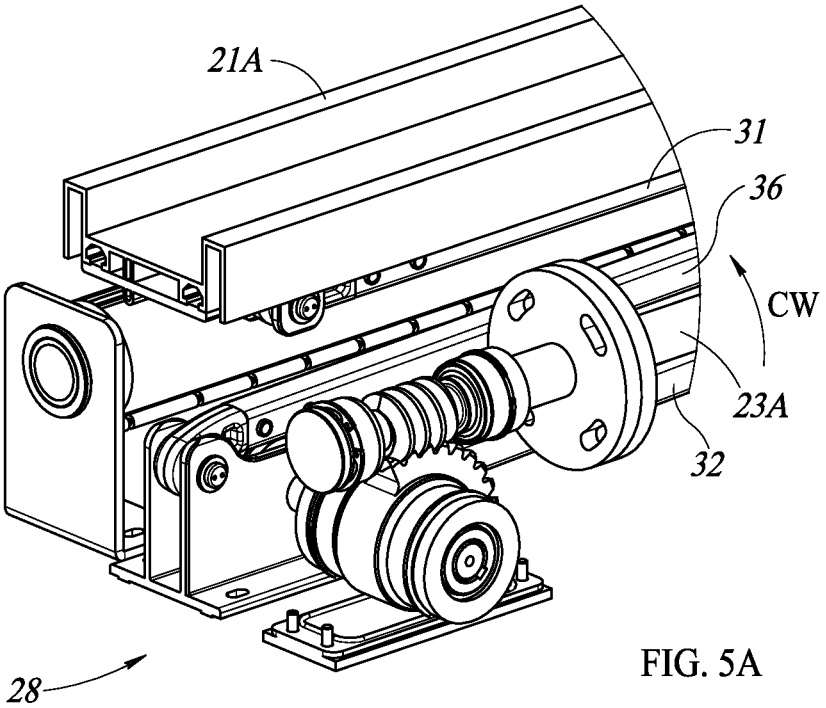
FIG. 5A is a close-up view of a left worm gear of the motorized barrier device in its storage position.
Figure 5B:
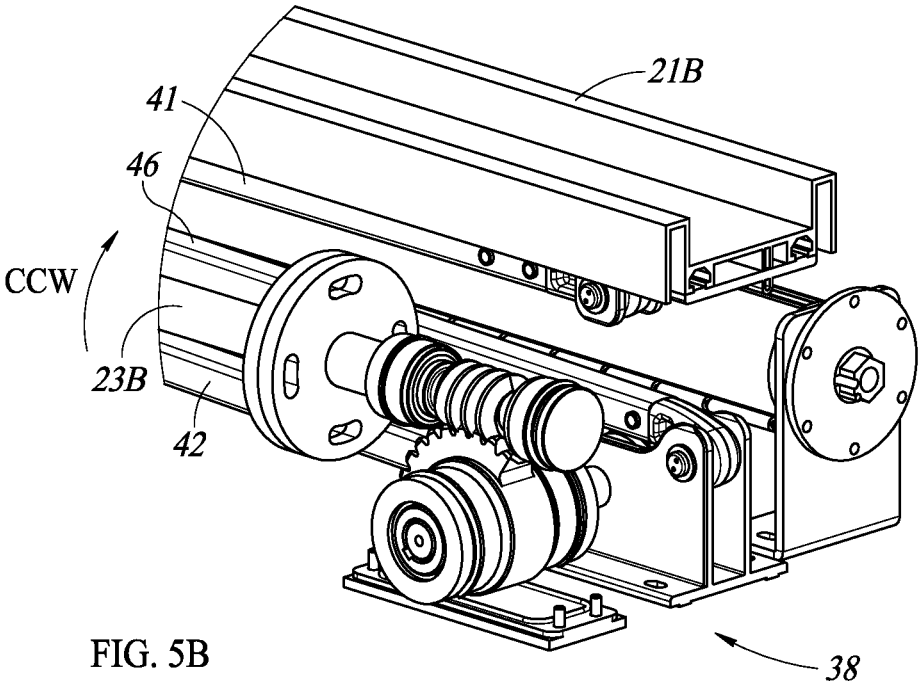
FIG. 5B is a close-up view of a right worm gear of the motorized barrier device in its storage position.

As shown in FIG. 5A, on viewing the left worm gear 28 from the gear transmission 26, clockwise rotation of the horizontal axle 23 causes the left worm gear 28 to upwardly rotate the left lower arm 32 a near quarter turn which in turn upwardly rotates the left upper arm 31 relative to the left lower arm 32 to extend the left folding arm 29. And as shown in FIG. 5B, the right worm gear 38 simultaneously upwardly rotates the right lower arm 42 a quarter turn which in turn upwardly rotates the right upper arm 41 relative to the right lower arm 42 to extend the right folding arm 39. Accordingly, the horizontal rigid beam 21 is raised from its storage position to its barrier position until restrained by the full extension of the flexible barrier fitment 22 to form the rigid frame 50.

Figure 6A:
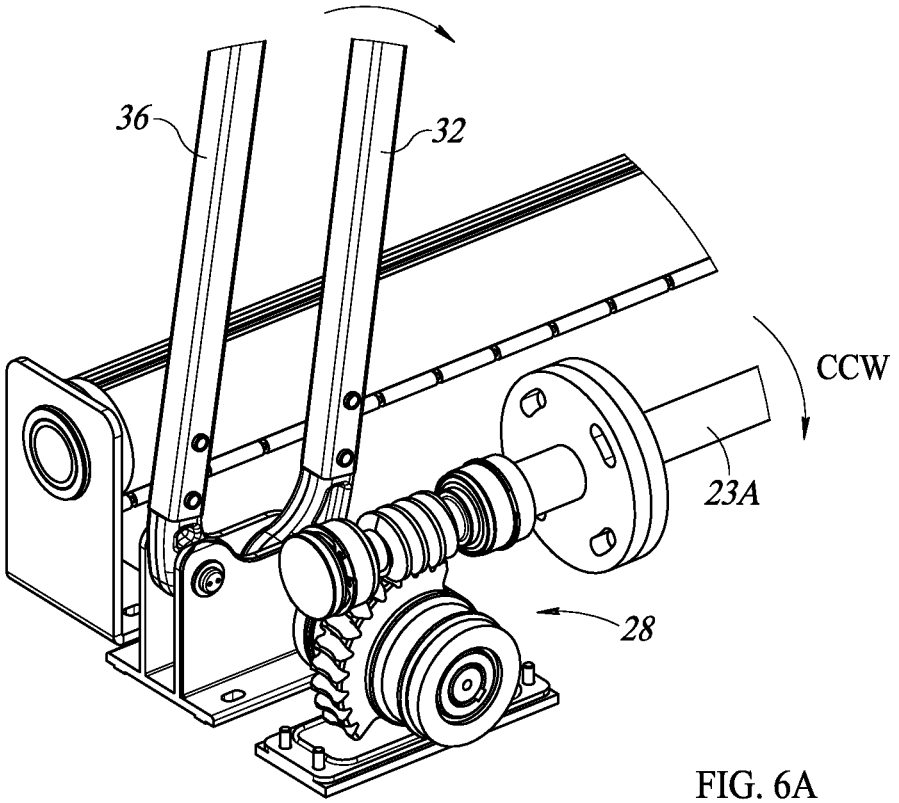
FIG. 6A is a close-up view of the motorized barrier device's left worm gear in its barrier position.
Figure 6B:
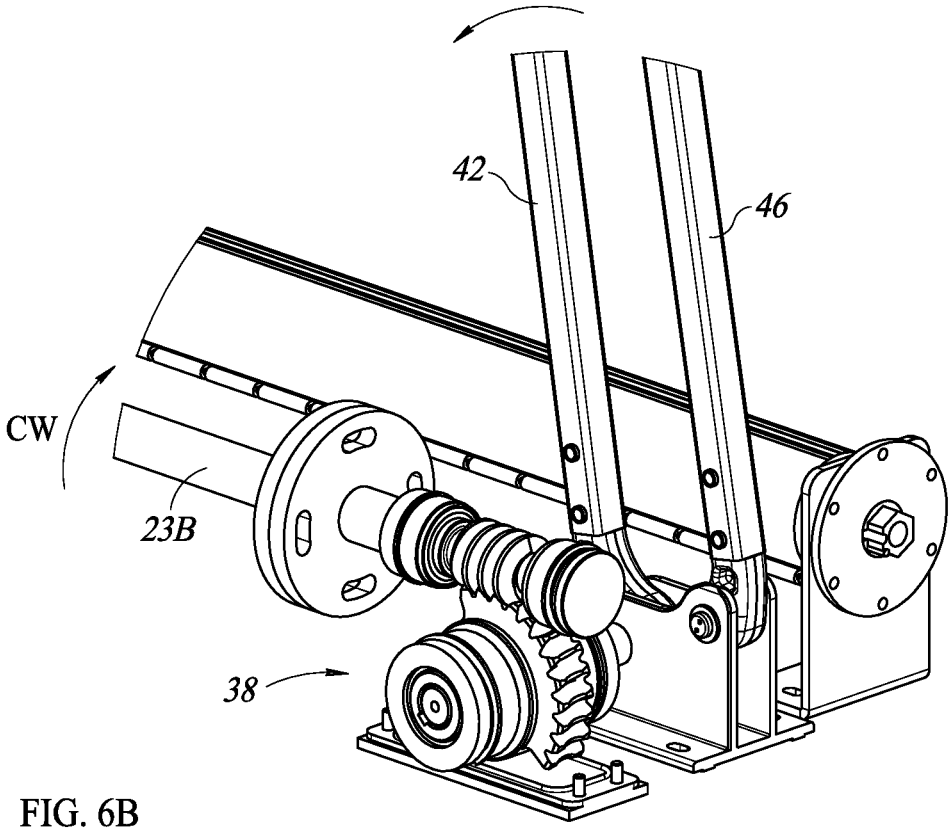
FIG. 6B is a close-up view of the motorized barrier device's right worm gear in its barrier position.

As shown in FIG. 6A, on viewing the left worm gear 28 from the gear transmission 26, counterclockwise rotation of the horizontal axle 23 causes the left worm gear 28 to downwardly rotate the left lower arm 32 a near quarter turn which in turn downwardly rotates the left upper arm 31 relative to the left lower arm 32 such that the left upper arm 31 overlies the left lower arm 32. And as shown in FIG. 6B, the right worm gear 38 simultaneously downwardly rotates the right lower arm 42 a near quarter turn which in turn downwardly rotates the right upper arm 41 relative to the right lower arm 42 such that the right upper arm 41 overlies the right lower arm 42. Accordingly, the rigid frame 50 collapses controllably enabling the flexible barrier fitment 22 to self-rewind in preparation for subsequent raising.

Figure 7A:
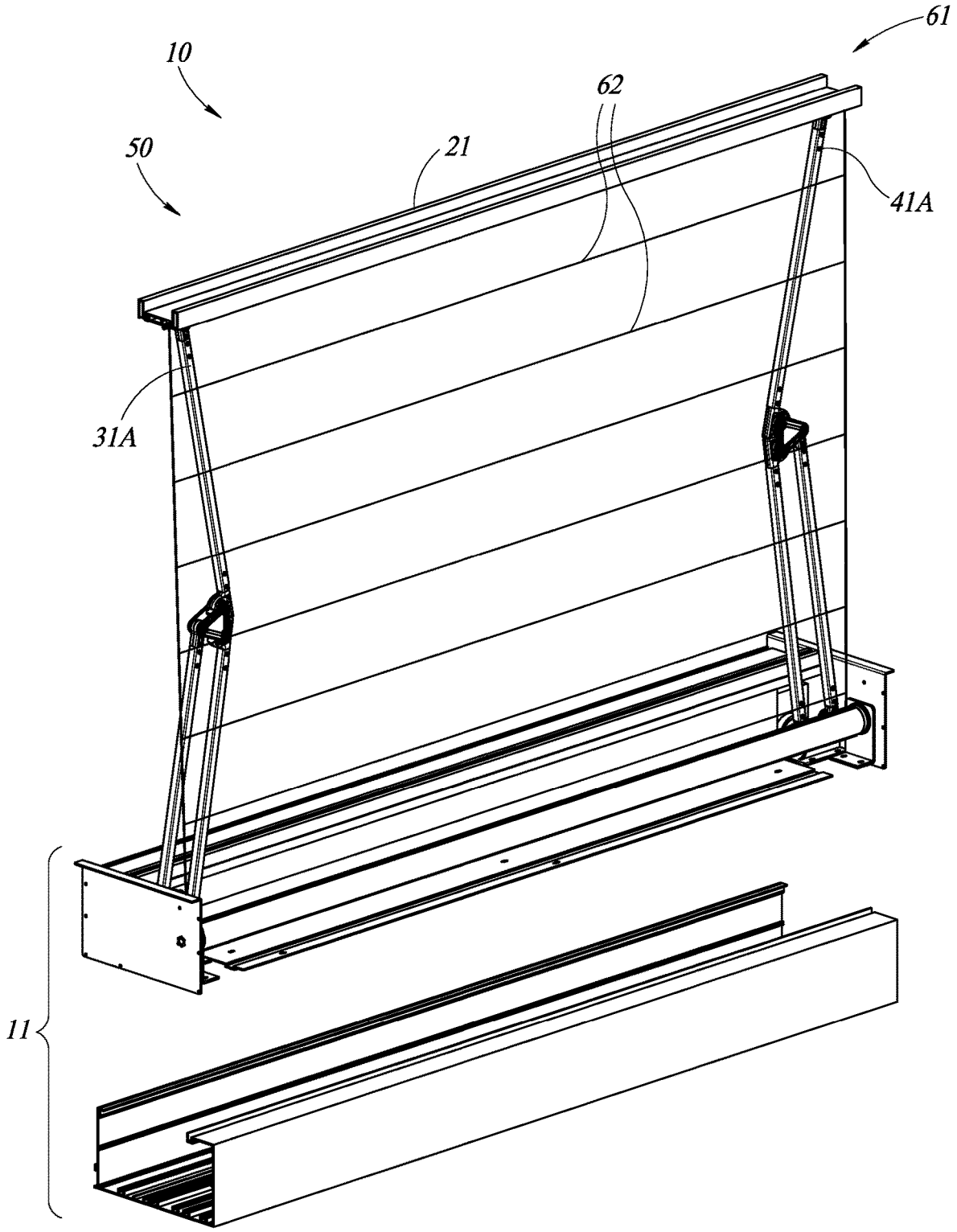
FIG. 7A is a partial exploded front perspective view of a motorized barrier device with a flexible barrier fitment constituted by horizontal wires in a barrier position.
Figure 7B:
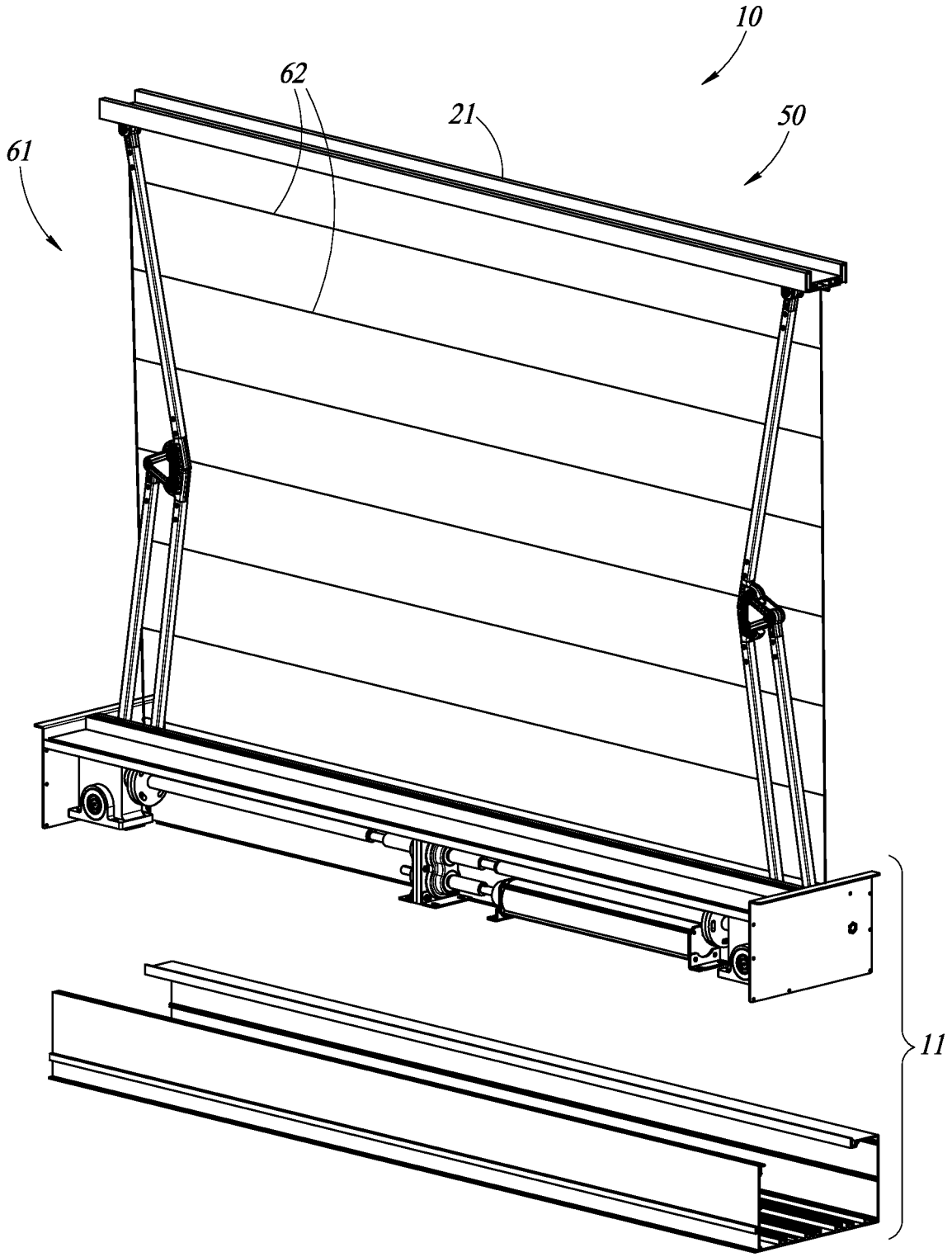
FIG. 7B is a partial exploded rear perspective view of the FIG. 7A motorized barrier device in its barrier position.

FIG. 7A and FIG. 7B show a barrier device 10 including a flexible barrier fitment 61 constituted by horizontal wires 62 extending between the left cable 48 and the right cable 49. Tautly stretching the left cable 48 and the right cable 49 heightwise in turn leads to tautly stretching the horizontal wires 62 therebetween.

Figure 8A:
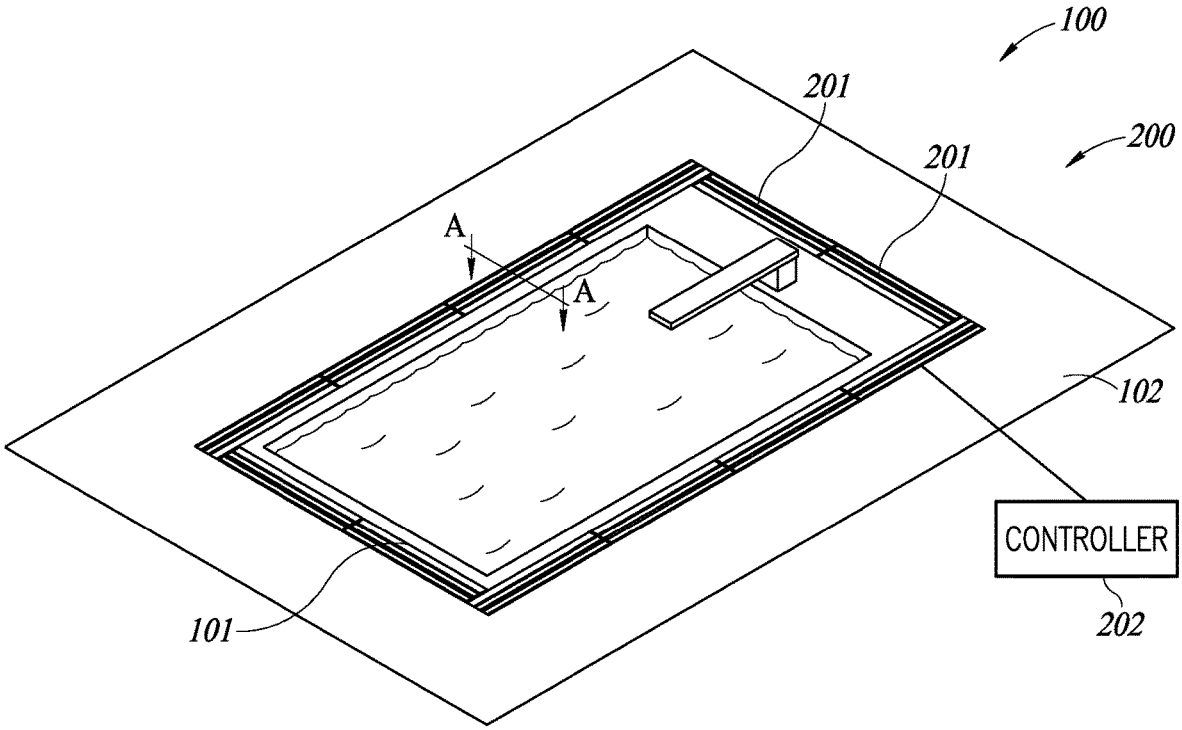
FIG. 8A is a pictorial view of an access management system enabling access to a swimming pool.
Figure 8B:
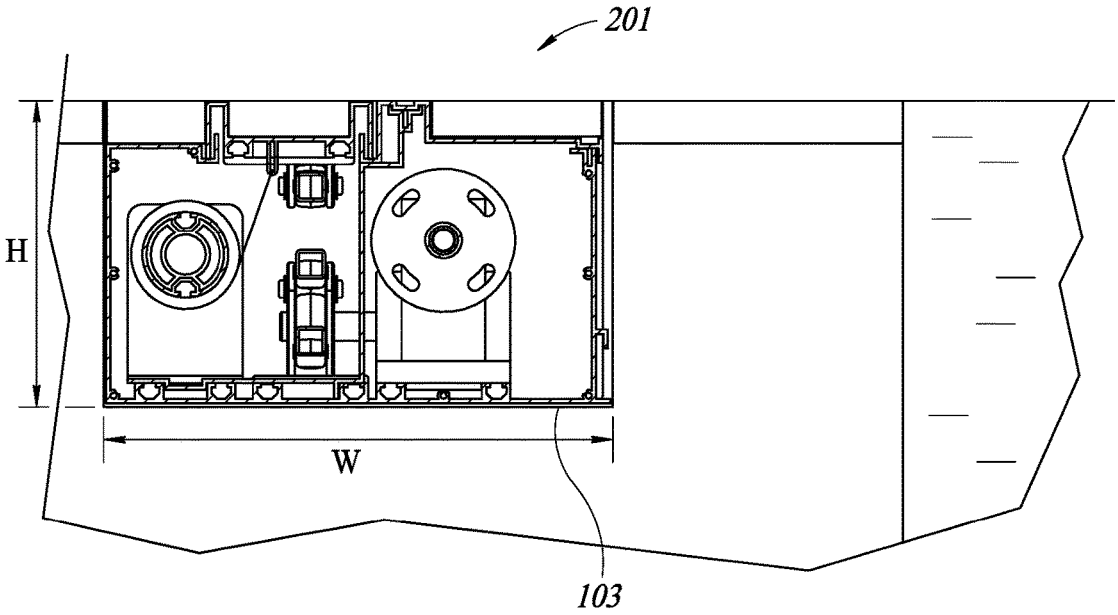
FIG. 8B is a transverse cross section along line A-A in FIG. 8A.
Figure 9A:
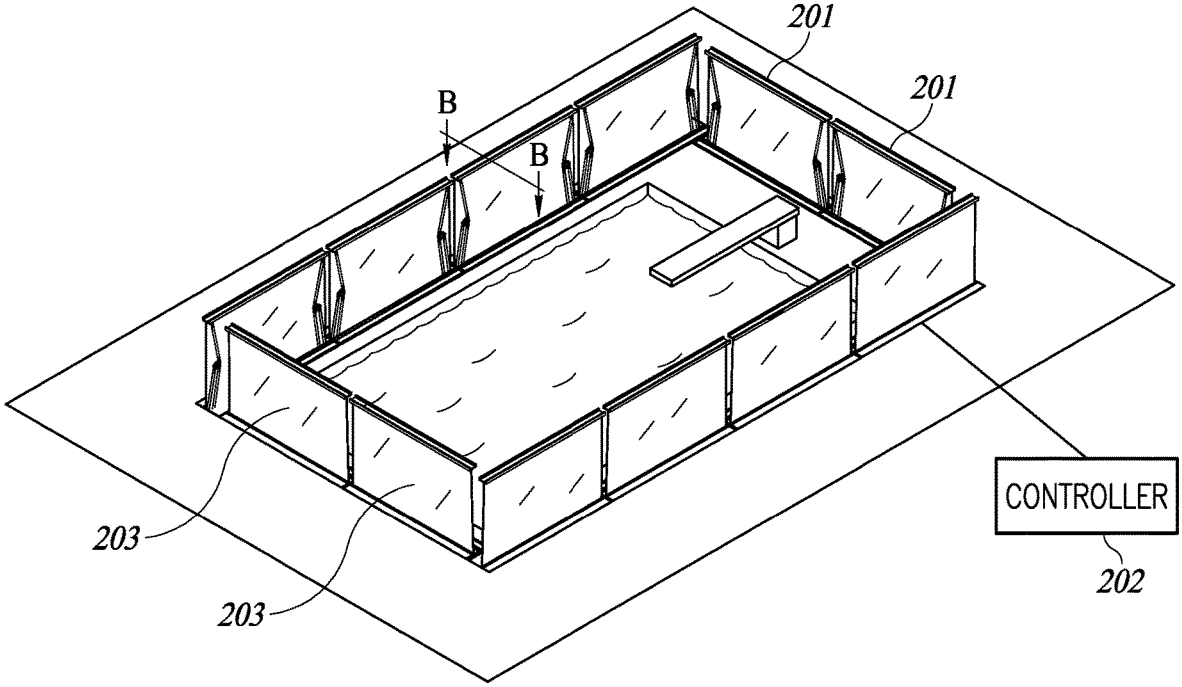
FIG. 9A is a pictorial view of the access management system disabling access to the swimming pool.
Figure 9B:
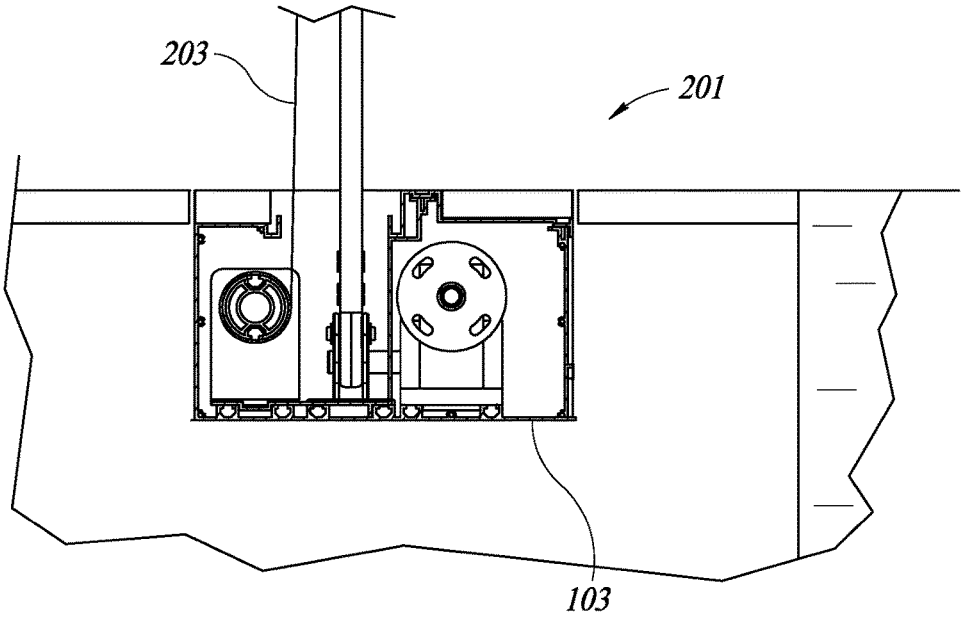
FIG. 9B is a transverse cross section along line B-B in FIG. 9A.

FIG. 8A to FIG. 9B show an installation 100 including a swimming pool 101 constituting a protected area. The installation 100 includes a pool deck 102 constituting a border surrounding the swimming pool 101. The installation 100 includes a trench 103 formed in the pool deck 102. The trench 103 preferably has the same height and width as the barrier device 10 such that it can snugly receive same. FIG. 8A and FIG. 9A show an access management system 200 for managing access to the swimming pool 101. The access management system 200 includes 12 barrier devices 201 surrounding the swimming pool 101 and a controller 202 for controlling their operation. The barrier devices 201 are deployed in the trench 103 such that they are flush fit with the pool deck 102 in their storage position (see FIG. 8A and FIG. 8B). Adjacent barrier devices 201 are placed side-by-side sufficiently closely to preclude passage therebetween. The barrier devices 201 preferably include flexible barrier fitments 203 enabling the swimming pool 101 to be seen therethrough in the disabling access position (see FIG. 9A and FIG. 9B).

While the invention has been described with respect to a limited number of embodiments, it will be appreciated that many variations, modifications, and other applications of the invention can be made within the scope of the appended claims.

The invention claimed is:

1. A motorized barrier device comprising:

a) a housing;

b) a horizontal axle mounted in said housing, said horizontal axle having a left axle end and a right axle end;

c) a horizontal rigid beam having a left beam end and a right beam end, said horizontal rigid beam having a storage position and a barrier position raised with respect to said storage position;

d) a left folding arm including:

a left upper arm having a leading left upper arm end pivotally connected to said horizontal rigid beam and a trailing left upper arm end with a left upper arm gear wheel, a left lower arm having a leading left lower arm end with a left lower arm gear wheel engaging said left upper arm gear wheel and a trailing left lower arm end, a left support arm including a leading left support arm end having a pivotally connected bracket pivotally connected to said trailing left upper arm end and said leading left lower arm end, and a trailing left support arm end pivotally connected to said housing, said left folding arm being rotatable between a substantially horizontal folded position overlying said horizontal axle and a substantially upright extended position;

e) a right folding arm including:

a right upper arm having a leading right upper arm end pivotally connected to said horizontal rigid beam and a trailing right upper arm end with a right upper arm gear wheel, a right lower arm having a leading right lower arm end with a right lower arm gear wheel engaging said right upper arm gear wheel and a trailing right lower arm end, a right support arm including a leading right support arm end having a pivotally connected bracket pivotally connected to said trailing right upper arm end and said leading right lower arm end, and a trailing right support arm end pivotally connected to said housing, said right folding arm being rotatable between a substantially horizontal folded position overlying said horizontal axle and a substantially upright extended position, said right folding arm and said left folding arm being folded toward one another in their said substantially horizontal folded positions and said right folding arm and said left folding arm being substantially parallel in their said substantially upright extended positions;

f) a left worm gear at said left axle end for driving said left folding arm between said folded position and said extended position;

g) a right worm gear at said right axle end for driving said right folding arm between said folded position and said extended position;

h) a motor for rotating said horizontal axle in one direction for driving said left worm gear and said right worm gear for raising said horizontal rigid beam from said storage position to said barrier position whereupon said housing, said left folding arm, said right folding arm and said horizontal rigid beam constitute a rigid frame, and said motor rotating said horizontal axle in an opposite direction for driving said left worm gear and said right worm gear for lowering said horizontal rigid beam from said barrier position to said storage position; and i) a self-winding flexible barrier fitment initially stored in said housing in said storage position and raised to form a barrier supported on said rigid frame in said barrier position, said flexible barrier fitment enabling raising said horizontal rigid beam from said storage position until being stretched tautly heightwise thereby determining said horizontal rigid beam's barrier position, and said flexible barrier fitment self-winding on lowering said horizontal rigid beam from said barrier position to said storage position.

2. The device according to claim 1 wherein said flexible barrier fitment includes a self-winding left cable on a left side of the barrier device and a self-winding right cable on a right side of the barrier device.

3. An access management system for managing access to a protected area, the access management system comprising:

(a) at least one motorized barrier device according to claim 1; and (b) a controller for controlling said at least one motorized barrier device.

4. An installation for protecting a protected area, the installation comprising at least one motorized barrier device according to claim 1 for managing access to the protected area.

5. The installation according to claim 4 wherein the installation includes a border adjacent the protected area and a trench in the border for deployment of said at least one motorized barrier device therein wherein said horizontal rigid beam in said storage position is flush with the border.

6. The installation according to claim 5 wherein the trench surrounds the protected area and said at least one motorized device are deployed in the trench to surround the protected area.

7. The installation according to claim 4 wherein said at least one motorized barrier device enables viewing the protected area therethrough.

8. The installation according to claim 4 wherein the protected area is a swimming pool.

9. The installation according to claim 4 and further comprising an access management system for controlling said at least one motorized barrier device.

10. A method for managing access to a protected area, the method comprising the steps of:

(a) providing at least one motorized barrier device according to claim 1; and (b) controlling the at least one motorized barrier device.

11. The method according to claim 10 wherein an installation includes a border adjacent the protected area and a trench in the border for deployment of said at least one motorized barrier device therein wherein its horizontal rigid beam in its storage position is flush with the border.

12. The method according to claim 11 wherein the trench surrounds the protected area and the at least one motorized device is deployed in the trench to surround the protected area.

13. The method according to claim 10 wherein the at least one motorized barrier device enables viewing the protected area therethrough.

14. The method according to claim 10 wherein the protected area is a swimming pool.

* * * * *